US006668516B2

(12) United States Patent
Sakaki et al.

(10) Patent No.: US 6,668,516 B2
(45) Date of Patent: Dec. 30, 2003

(54) PACKING APPARATUS

(75) Inventors: Yasunori Sakaki, Tokyo (JP); Tsutomu Tagomori, Yokohama (JP)

(73) Assignee: Strapack Corporation, Tokyo (JP)

( * ) Notice: Subject to any disclaimer, the term of this patent is extended or adjusted under 35 U.S.C. 154(b) by 0 days.

(21) Appl. No.: 10/161,768

(22) Filed: Jun. 4, 2002

(65) Prior Publication Data

US 2003/0061785 A1 Apr. 3, 2003

(30) Foreign Application Priority Data

Sep. 28, 2001 (JP) ..... 2001-302691
May 23, 2002 (JP) ..... 2002-149416

(51) Int. Cl.[7] ..... B65B 57/02; B65B 13/32

(52) U.S. Cl. ..... 53/64; 53/589; 53/375.9; 100/4; 100/26; 100/33 PB

(58) Field of Search ..... 53/64, 589, 590, 53/592, 375.9; 100/4, 26, 29, 32, 33 PB

(56) References Cited

U.S. PATENT DOCUMENTS 3,672,295 A * 6/1972 Weller ..... 100/4
3,875,855 A * 4/1975 Clark et al. ..... 100/4
4,074,508 A * 2/1978 Reid ..... 53/590
4,262,587 A * 4/1981 Russell ..... 100/4
5,146,847 A * 9/1992 Lyon et al. ..... 53/589
5,379,687 A * 1/1995 Moseley ..... 100/26
6,038,967 A * 3/2000 Chak et al. ..... 53/64
6,363,689 B1 * 4/2002 Rodriguez et al. ..... 53/589
6,415,712 B1 * 7/2002 Helland et al. ..... 53/589

FOREIGN PATENT DOCUMENTS

JP 57-153817 A 9/1982
JP 5-81002 U 11/1993
JP 11-171124 A 6/1999

* cited by examiner

*Primary Examiner*—Stephen F. Gerrity
(74) *Attorney, Agent, or Firm*—Frishauf, Holtz, Goodman & Chick, P.C.

(57) ABSTRACT

The distal end of a band remains held after a band-holding step. A band-tightening step is performed by operating a manual tightening switch, thereby driving a drive motor and hence rotating a drive roller under manual control. A band-sealing step and a band-feeding step are automatically and sequentially performed after a tightening stop switch is operated, generating a manual-tightening end signal. It is desirable to use a mode-changing switch for switching an operating mode of the apparatus between an automatic mode and a manual mode. The manual tightening switch and the tightening stop switch are effective in the manual mode and are ineffective in the automatic mode.

6 Claims, 8 Drawing Sheets

PACKING APPARATUS

BACKGROUND OF THE INVENTION

1. Field of the Invention

The present invention relates to a packing method of packing an article in which an article is packed by wrapping a band around the article, tightening the band, cutting the band and adhering the ends of the band to each other, and also a packing apparatus for packing an article.

2. Description of the Prior Art

So-called "band-wrapping packing apparatuses" are known, which wrap a band around an article, tighten the band, cut the band and adhere the ends of the band to each other. The band-wrapping packing apparatuses comprise, for example, a sealing device and a band-feeding device. The sealing device has a sealing motor. When the sealing motor is driven, the sealing device holds a band, cuts the band and adhere the ends of the band to each other. The band-feeding device has a band reel, a drive motor and a drive roller. The drive motor can rotate the drive roller in a forward direction and the reverse direction. When rotated in the forward direction, the drive roller feeds a band from a band reel. When rotated in the reverse direction, the drive roller draws back the band and tightens the band.

The method in which a packing apparatus of this type packing an article comprises the following five steps:

(1) Band-inserting step of wrapping a band around the article and inserting the distal end of the band into a band insertion port;

(2) Band-holding step of holding the end of the band, which has been inserted into the band insertion port;

(3) Band-tightening step of drawing the band back, thus tightening the band around the article with an appropriate force;

(4) Band-sealing step of cutting the band and adhering the ends of the band to each other; and (5) Band-feeding step of feeding the band for a prescribed distance from the band reel.

Packing apparatuses are classified into two types. The first type is an automatic one. The second type is a semiautomatic one.

The automatic packing apparatus has an arch unit. The arch unit is located above the table supporting the article to be packed or at one side of the table.

In the automatic packing apparatus, a band is automatically fed from the band reel into the arch unit. In the arch unit, the distal end of the band is inserted into the band insertion port and is held fast. When a power switch on the automatic packing apparatus is turned on, the band-feeding step, band-inserting step and band-holding step are automatically carried out. Thus, when a start switch on the apparatus is turned on after an article has been placed on the table, the apparatus carries out the band-tightening step and band-sealing step, thus automatically packing the article. The apparatus then performs the band-feeding step, band-inserting step and band-holding step, in preparation for the next packing cycle. In the band-tightening step, the band is pulled back from the arch unit, wrapped around the article and tightened around the article.

By contrast, the semiautomatic packing apparatus has no arch unit. After feeding a band for a prescribed distance, the apparatus waits until the power switch is turned on. The operator puts an article on the table, wraps the band around the article and inserts the end of the band into the band insertion port. When the end of the band is inserted into the port, the power switch is automatically turned on. Then, the apparatus automatically carries out the band-holding step, band-tightening step and band-sealing step, one after another. The article is thereby packed. Then, the apparatus performs the band-feeding step, in preparation for the next packing cycle. In the semiautomatic packing apparatus, the band-inserting step is manually performed, whereas the band-holding step, band-tightening step, band-sealing step and band-feeding step are automatically carried out, one after another.

In the packing apparatus, either automatic or semiautomatic, all steps, except the band-inserting step, are effected under automatic control that is accomplished by the sealing motor, the drive motor, and the like.

In the packing apparatus of either type, the force adjustment dial is turned to adjust and set a desired force for tightening the band. The apparatus of either type stops tightening the band when a sensor detects that the force applied to the band reaches the desired value. The semiautomatic packing apparatus has a band-length dial, too. This dial may be turned to preset a distance for which to feed the band in the band-feeding step.

In the automatic packing apparatus, the packing sequence starts when the start switch is manually turned on. In the semiautomatic packing apparatus, the packing sequence starts when the start switch is automatically turned on after the end of a band is manually inserted into the band insertion port. In either type of the apparatuses, the packing sequence cannot be interrupted once it has started. In other words, once started, the packing sequence continues until it completes one cycle of operation.

The conventional packing apparatuses, in which the packing sequence cannot be interrupted once the start switch is turned on, are disadvantageous in the following respects:

(1) If the band is wrapped around the article and tightened at a wrong position on the article, the position cannot be easily corrected. Further, if the band tightened around the article extends obliquely, it can hardly be straightened as is desired.

(2) Protective plates can hardly be placed on the article at desired positions to prevent the band from being wrapped directly on the article. This is because the operator's hands may be caught in the gap between any protective plate and the band. Once arranged on the article, the protective plates cannot be easily adjusted in position.

(3) If the force preset to tighten the band around the article is improper, it cannot be adjusted at all.

If the band wrapped around the article can hardly straightened, if the protective plates cannot be adjusted in position, or if the force of tightening the band cannot be adjusted, the band must be cut and the packing sequence must be repeated. This lowers the packing efficiency. Particularly in packing a cardboard box, the band must be cut and the packing sequence needs to be performed again since the band is tightened while the two straps at the open top remain standing and these straps may not be closed.

Japanese Patent Application KOKAI Publication No. 57-153817, for example, discloses a packing method in which the band-tightening step is divided into a preliminary tightening step and a final tightening step. A band is tightened with a smaller force in the preliminary tightening step than in the final tightening step. After the preliminary tightening step and before the final tightening step, the band can be corrected in position and orientation, and any protective plate used can be adjusted in position. The final tightening step can be carried out, for example, while pushing the two straps of a cardboard box to close the open top thereof. Thus, the cardboard can packed and closed at the same time. In this packing method, too, the band is tightened with a preset force that cannot be adjusted at all.

Japanese Patent Application KOKAI Publication No. 57-153817 discloses a packing apparatus, too. This apparatus needs to have a preliminary tightening roller and a final tightening roller, in addition to the drive roller, and a mechanism for moving one of the band-tightening rollers. The preliminary tightening roller remains in contact with the drive roller. The mechanism moves the final tightening roller between two positions. At the first position, the final tightening roller contacts the drive roller. At the second position, it does not contact the drive roller. Comprising three rollers, the packing apparatus is complicated in construction.

Japanese Patent Application KOKAI Publication No. 11-171124 discloses a packing method. In this method, the drive roller is driven at a high speed in the first half of the band-tightening step and at a low speed in the latter half of the band-tightening step. More precisely, the drive roller draws a band back at 6 m/sec in the first half of the step, wrapping the band around an article, and pulls the band at 0.2 m/sec in the latter half of the step, tightening the band wrapped around the article. In the packing method, the band is pulled and tightened at a low speed in the latter half of the band-tightening step. This gives the operator a time long enough to correct the position and orientation of the band and to adjust the positions of the protective plates placed between the article and the band. In the first half of the band-tightening step, the band is drawn back for only the time set by a timer. In the latter half of the band-tightening step, the band is pulled until a sensor detects that the tension on the band reaches a preset value. It is therefore impossible to adjust the tension on the band, i.e., the force that tightens the band. An apparatus that performs this packing method must have a timer and a tension sensor and is inevitably complicated in construction.

SUMMARY OF THE INVENTION

A first object of the present invention is to provide a packing method which enables the operator to adjust the position and orientation of a band wrapped around an article, the positions of protective plates placed between the article and the band, and the force tightening the band.

A second object of the invention is to provide a packing apparatus which makes it easy for the operator to adjust the position and orientation of a band wrapped around an article and the positions of protective plates placed between the article and the band, which enables the operator to adjust the force tightening the band, and which can be simple in construction.

To achieve the first object, there is provided a packing method in which the distal end of a band is held even after the band-holding step, a switch is manually operated to control the drive roller in the next step, i.e., band-tightening step, and the band-sealing step and band-feeding step are automatically performed, after a signal is generated, indicating that the band-tightening step has been completed.

To attain the second object, there is provided a packing apparatus that comprises a band-tightening switch and a tightening stop switch, in addition to a sealing device and a band-feeding device. The band-feeding device has a drive roller. The tightening stop switch is manually operated to control the rotation of the drive roller. The tightening stop switch generates a signal indicating that a band has been completely tightened around an article.

DETAILED DESCRIPTION OF THE PREFERRED

Embodiments

Figure 1:
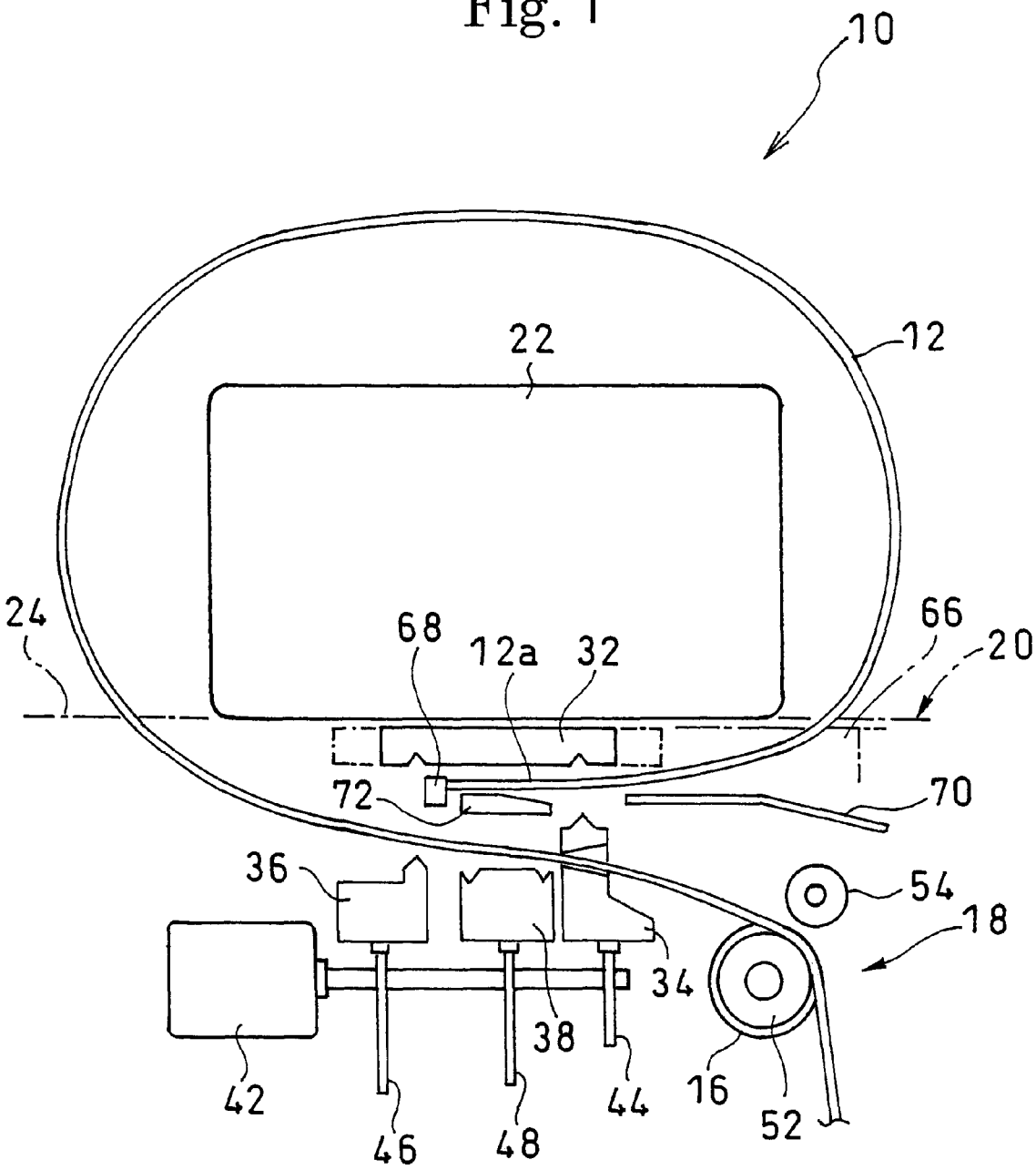
FIG. 1 is a diagram illustrating how a packing apparatus according to the invention operates, with the distal end of a band inserted in the band insertion port.
Figure 2:
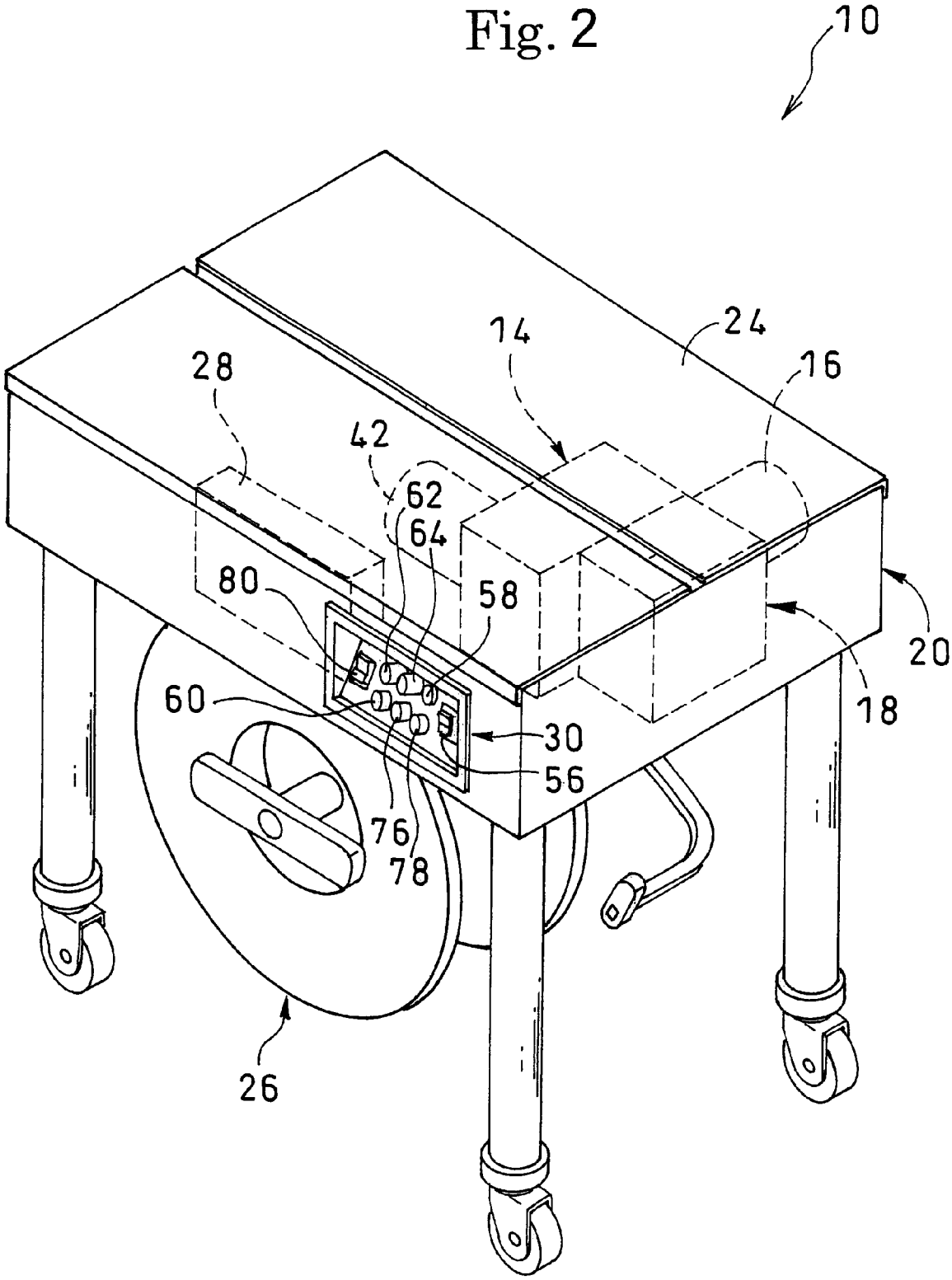
FIG. 2 is a perspective view of the packing apparatus of the present invention.

As FIGS. 1 and 2 show, a packing apparatus 10 according to the present invention comprises a sealing device 14, a band-feeding device 18 and a body unit 20. The packing apparatus 10 is configured to wrap a band 12 around an article 22 and pack the article 22. The body unit 20 incorporates the band-feeding device 18. The sealing device 14 has a sealing motor 42. When the sealing motor 42 is driven, the sealing device 14 holds the distal end of the band 12, cuts a length of the band 12 from the other part thereof, and adheres the ends of the length of the band 12. The band-feeding device 18 has a drive motor 16 and a drive roller 52. The drive motor 16 is a reversible motor; its shaft can rotate in the forward direction and the reverse direction. When rotated in the forward direction, the drive motor 16 drives the roller 52, which feeds the band 12 forwards. When rotated in the reverse direction, the driver motor drives the roller 52, which draws the band 12 back to tighten the same.

It should be noted that the apparatus 10 is, for example, a so-called semiautomatic packing apparatus. Therefore, the operator wraps the band 12 around the article 22 and inserts the distal end of the band 22 into the band insertion port.

As seen from FIG. 2, the body unit 20 of the semiautomatic packing apparatus 10 comprises a table 24 and a reel unit 26. The table 24 supports the article 22 to be packed. The reel unit 26 is located under the table 24 and has a band reel 16. The body unit 20 contains a control means 28, as well as the sealing device 14 and the band-feeding device 18. The control means 28 comprises a CPU (Central Processing Unit).

A control panel 30 is provided on, for example, the front of the body unit 20. The control panel 30 has switches, dials and the like that are connected to the control means 28 as will be described later in detail. When the switches, dials etc. of the control panel 30 are operated, the control means 28 controls the sealing device 14 and the band-feeding device 18 as is desired.

Figure 4:
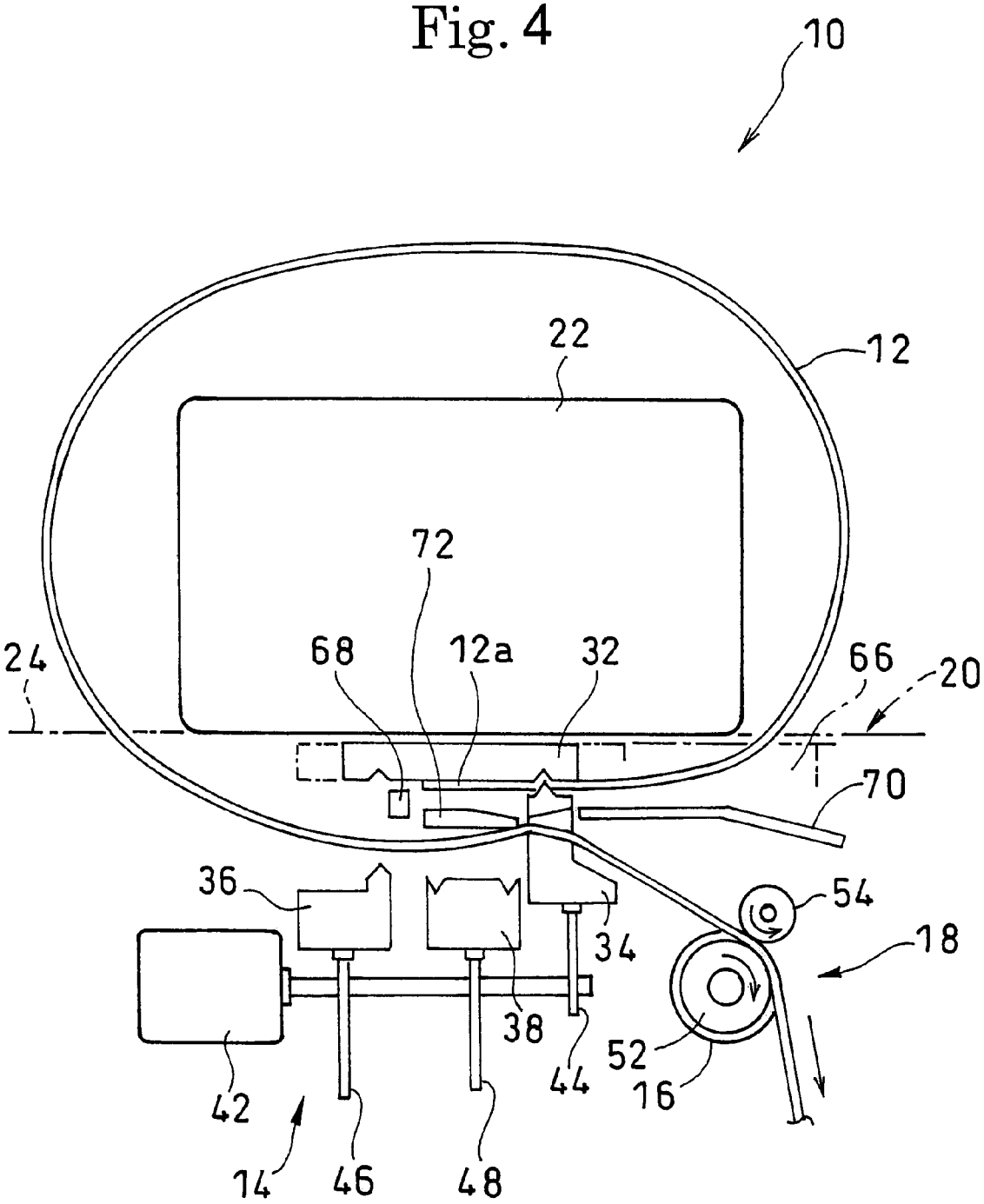
FIG. 4 is a diagram illustrating how the packing apparatus of the invention performs the band-holding step.
Figure 6:
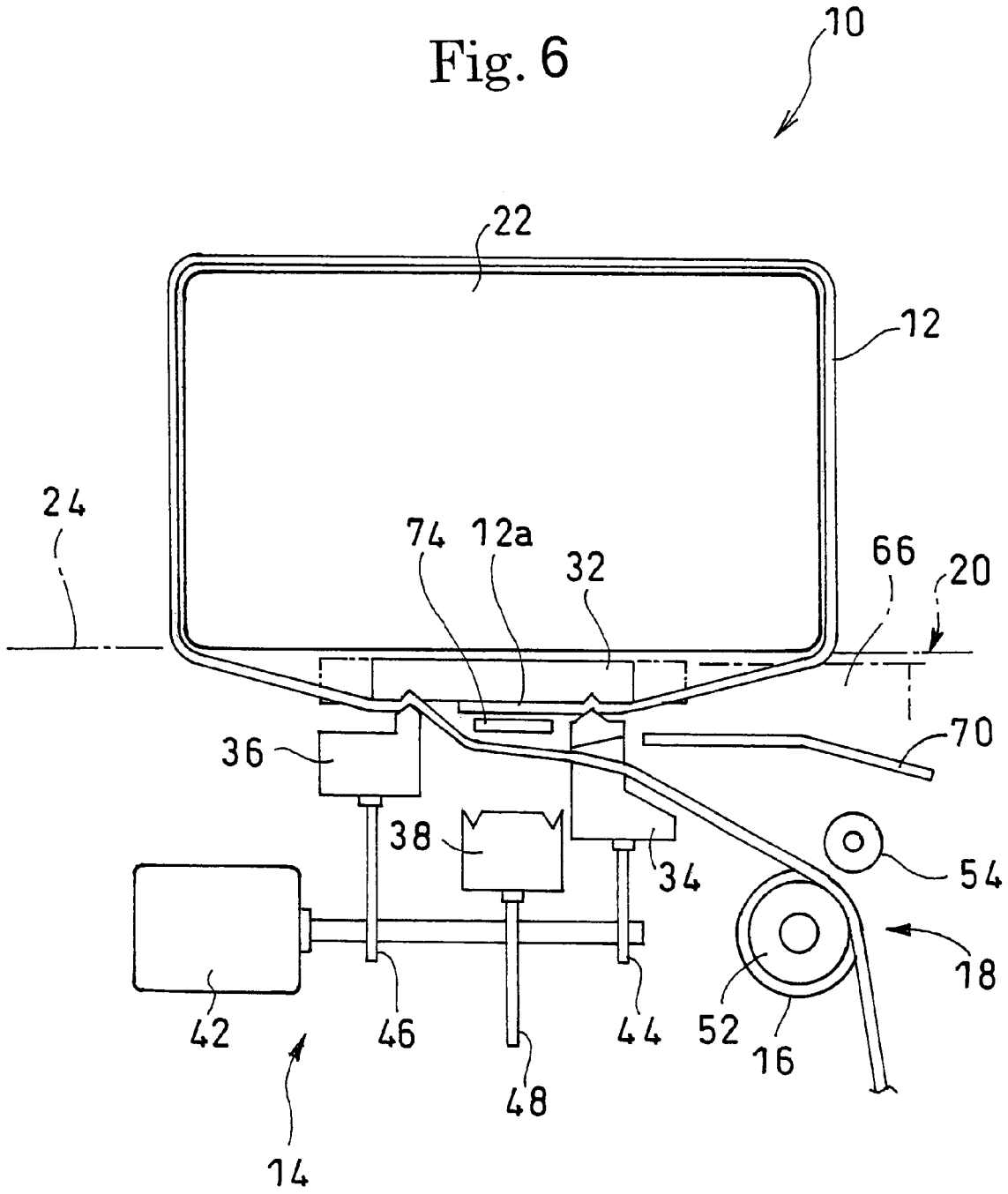
FIG. 6 is a diagram illustrating how the packing apparatus of the invention operates before the band is cut in the band-sealing step.
Figure 7:
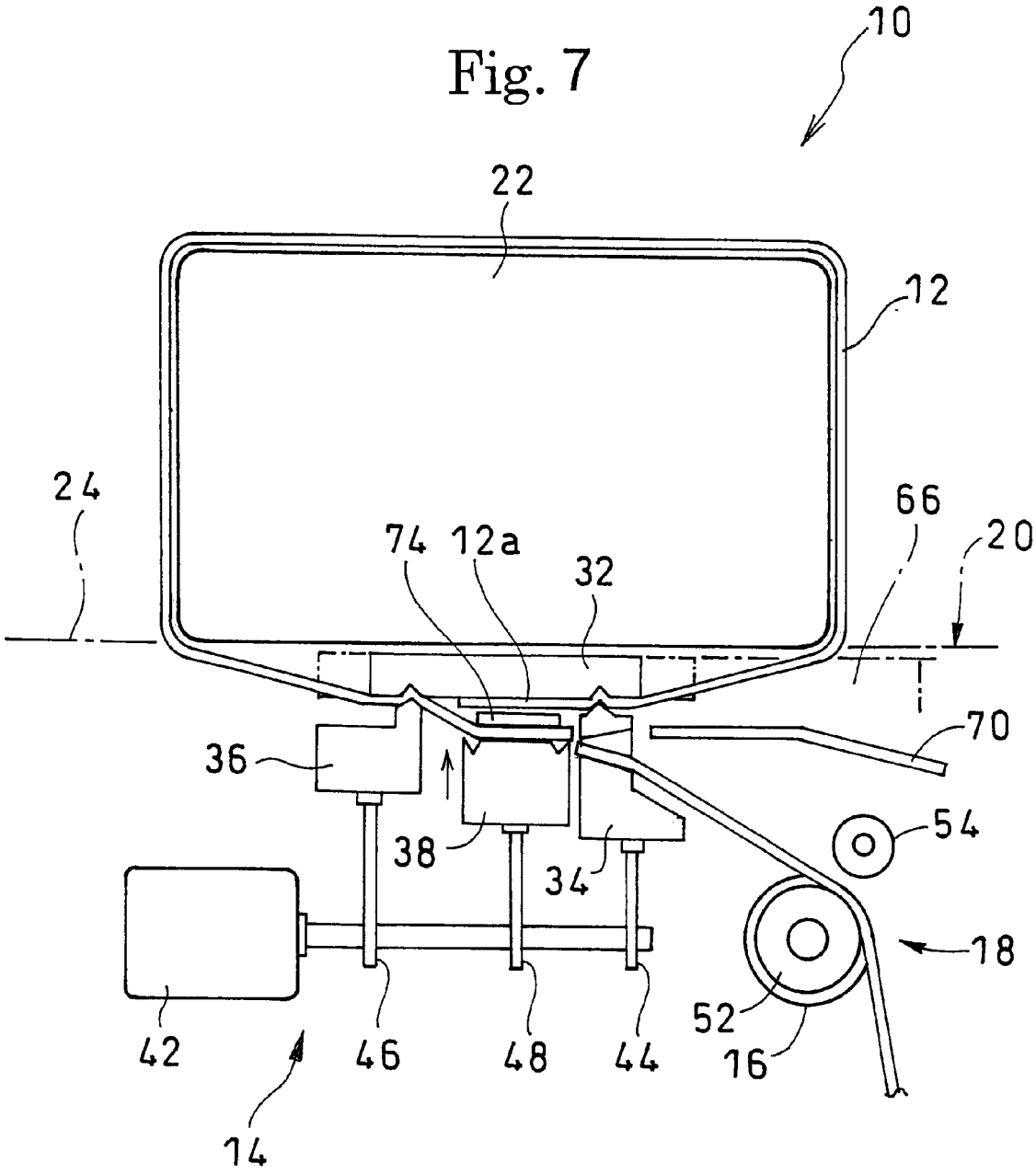
FIG. 7 is a diagram illustrating how the packing apparatus of the invention operates after the band is cut in the band-sealing step.

As FIG. 1 shows, the sealing device 14 comprises a right block 34, a left block 36, a center block 38, and a heater 74. The blocks 34, 36 and 38 can be moved up and down. The heater 74 can be moved back and forth. When moved upwards, the right block 34 holds the distal end of the band 12 as shown in FIG. 4, clamping the same between it and the slide table 32 that is arranged beneath the table 24. When moved upwards, the left block 36 holds the band 12 tightened around the article 22, as is illustrated in FIG. 6. The center block 38 has a cutter. The cutter cuts the band 12 as shown in FIG. 7 when the center block 38 is moved upwards. At the same time, the center block 38 pushes distal end of the band 12 onto the heater 74 that has moved forward. The heater 74, therefore, melts the distal end of the band 12.

Three cams 44, 46 and 48 are mounted on the shaft of the sealing motor 42. The cam 44 controls the motion of the right block 34; the cam 46 controls the motion of the left block 36; the cam 48 controls the motion of the center block 38.

Figure 3:
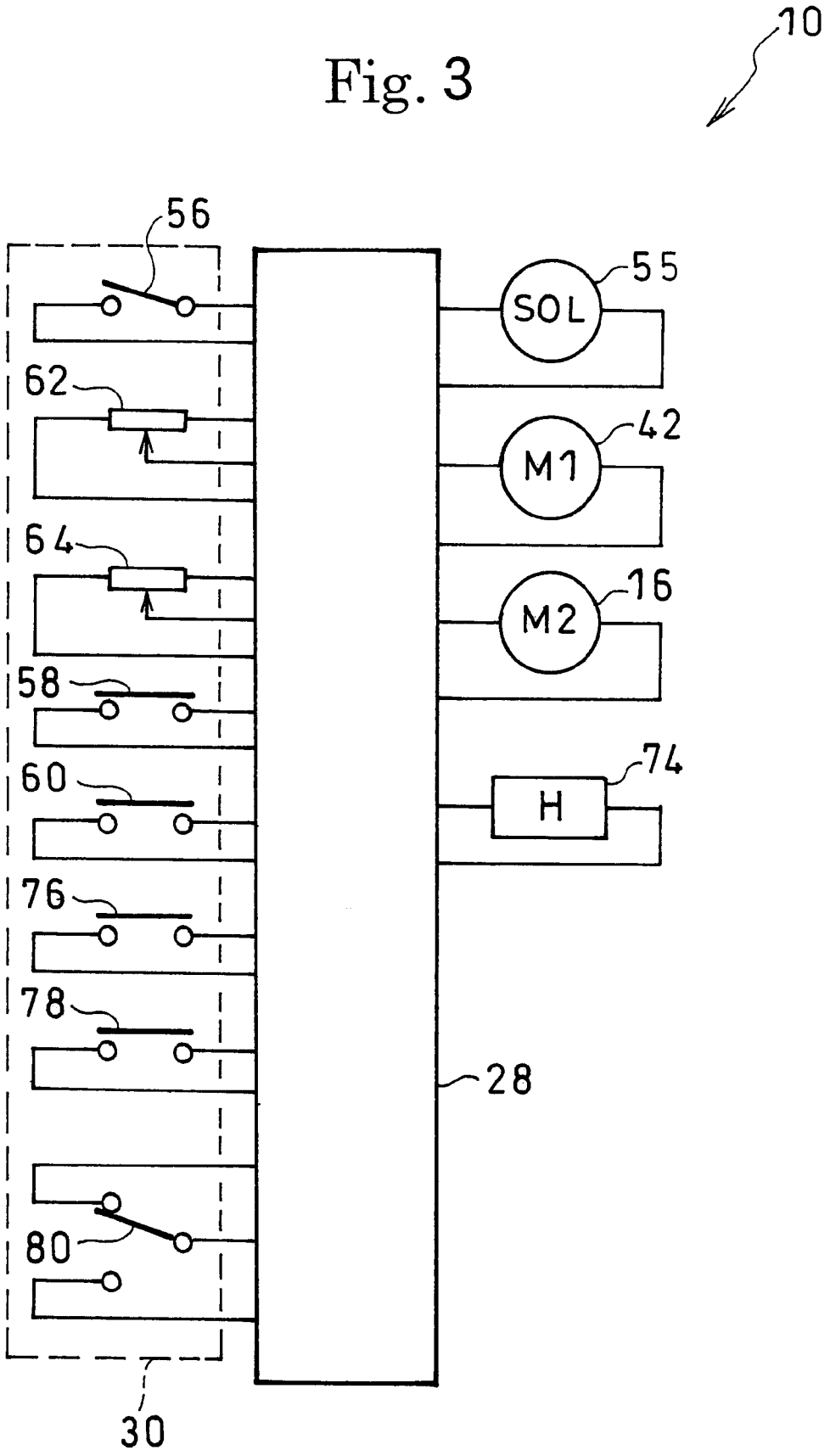
FIG. 3 is a block diagram of the packing apparatus according to the invention.

As FIG. 3 shows, the sealing motor 42 is electrically connected to the control means 28. The sealing motor 42 is controlled by an electric signal supplied from the control means 28. The rotations of the cams 44, 46 and 48 are thereby controlled.

As is illustrated in FIG. 1, the band-feeding device 18 further comprises a drive roller 52, a solenoid 55 (see FIG. 3), and a touch roller 54. The drive roller 52 is secured to the shaft of the drive motor 16. When the solenoid 55 is turned on, the touch roller 54 is pushed on the drive roller 52. The touch roller 54, thus pushed, clamps the band 12, jointly with the drive roller 52. When the drive motor 16 is driven, rotating the drive roller 52 in a prescribed direction (counterclockwise direction, in the embodiment), the band 12 is forwarded for the prescribed distance. When the drive motor 16 is driven, rotating the drive roller 52 in a reverse direction (clockwise direction, in the embodiment), the band 12 is pulled back and tightened around the article 22.

As FIG. 3 shows, the solenoid 55 configured to move the touch roller 54 is electrically connected to the control means 28, just like the drive motor 16.

The sealing device 14 and the band-feeding device 18 are substantially identical in basic structure to those provided in such a known semiautomatic packing apparatus as is disclosed in Japanese Utility Model Application KOKAI Publication No. 5-81002. Therefore, neither the sealing device 14 nor the band-feeding device 18 will be described in detail.

As seen from FIG. 3 in conjunction with FIG. 2, the control panel 30 has a power switch 56, a reset switch 58, a dial 62, a switch 60, and a dial 64. When operated, the power switch 56 turns on or off, the power supply to the packing apparatus 10. The reset switch 58 may be operated to move the sealing device 14 back to the initial position. The dial 62 may be turned to set a distance for which to feed the band 12. The switch 60 may be operated to drive the drive motor 16 in a prescribed direction, thereby to feed the band 12 for the distance set by turning the dial 62. The dial 64 may be turned to set a force for tightening the band 12 wrapped around the article 22. The power switch 56, reset switch 58, dial 62, switch 60 and dial 64 are electrically connected to the control means 28.

The switches and dials are of the types provided on the known packing apparatuses. How they operate will not be described here.

The packing apparatus 10, which is an embodiment of the present invention, further comprises a manual-tightening switch 76, a tightening stop switch 78, and a mode-changing switch 80. These switches 76, 78 and 80 are arranged on the control panel 30 and connected to the control means 28.

The mode-changing switch 80 may be operated to change the operating mode of the apparatus 10, between an automatic mode and a manual mode. The automatic mode is identical to the operating mode of the known semiautomatic packing apparatuses. The manual mode is unique to the packing apparatus 10 of this invention. The manual tightening switch 76 and the tightening stop switch 78 can be operated after the apparatus 10 has been set to the manual mode by operating the mode-changing switch 80. Once the operator operates the manual-tightening switch 76, he or she can manually control the drive motor 16 to rotate the drive roller 52. Upon the manual control of the drive motor 16 is completed, the tightening stop switch 78 is turned on, supplying a manual-tightening end signal to the control means 28.

In the automatic mode, the start switch is turned on when the band 12 is inserted into the band insertion port. Thus turned on, the start switch initiates the sequence of packing steps. The article 22 is thereby packed in the same way as in the known semiautomatic packing apparatus.

How the packing apparatus 10 operates when set in the manual mode will be explained. The operator may put the article 22 on the table 24, turn on the power switch 56 and operate the mode-changing switch 80, setting the apparatus 10 into the manual mode.

Then, the operator holds that part of the band 12 that has been fed for the prescribed distance from the band reel of the reel unit 26. The operator pulls the band 12, wraps it around the article 22 and inserts the distal end of the band 12 into the band insertion port, as is illustrated in FIG. 1. Thus, the operator inserts the distal end of the band 12 into the band insertion port in the semiautomatic packing apparatus 10, whichever operating mode the mode-changing switch 80 is set into, the automatic mode or the manual mode.

When the band 12 abuts on the start switch, or a striker 68, the start switch is turned on. When the start switch (i.e., striker 68) is turned on, the sealing motor 42 is driven, rotating the cams 44, 46 and 48. The cam 44 moves the right block 34 up. Thus moved, the right block 34 clamps and holds the distal end 12*a* of the band 12 between it and the slide table 32 as shown in FIG. 4. Then, the sealing motor 42 stops rotating, whereby the band-holding step is completed.

In the automatic mode, the next band-tightening step starts upon the completion of the band-holding step. In the manual mode, the next band-tightening step does not start even after the completion of the band-holding step, and the packing apparatus 10 waits, while holding the distal end 12*a* of the band 12.

Figure 5:
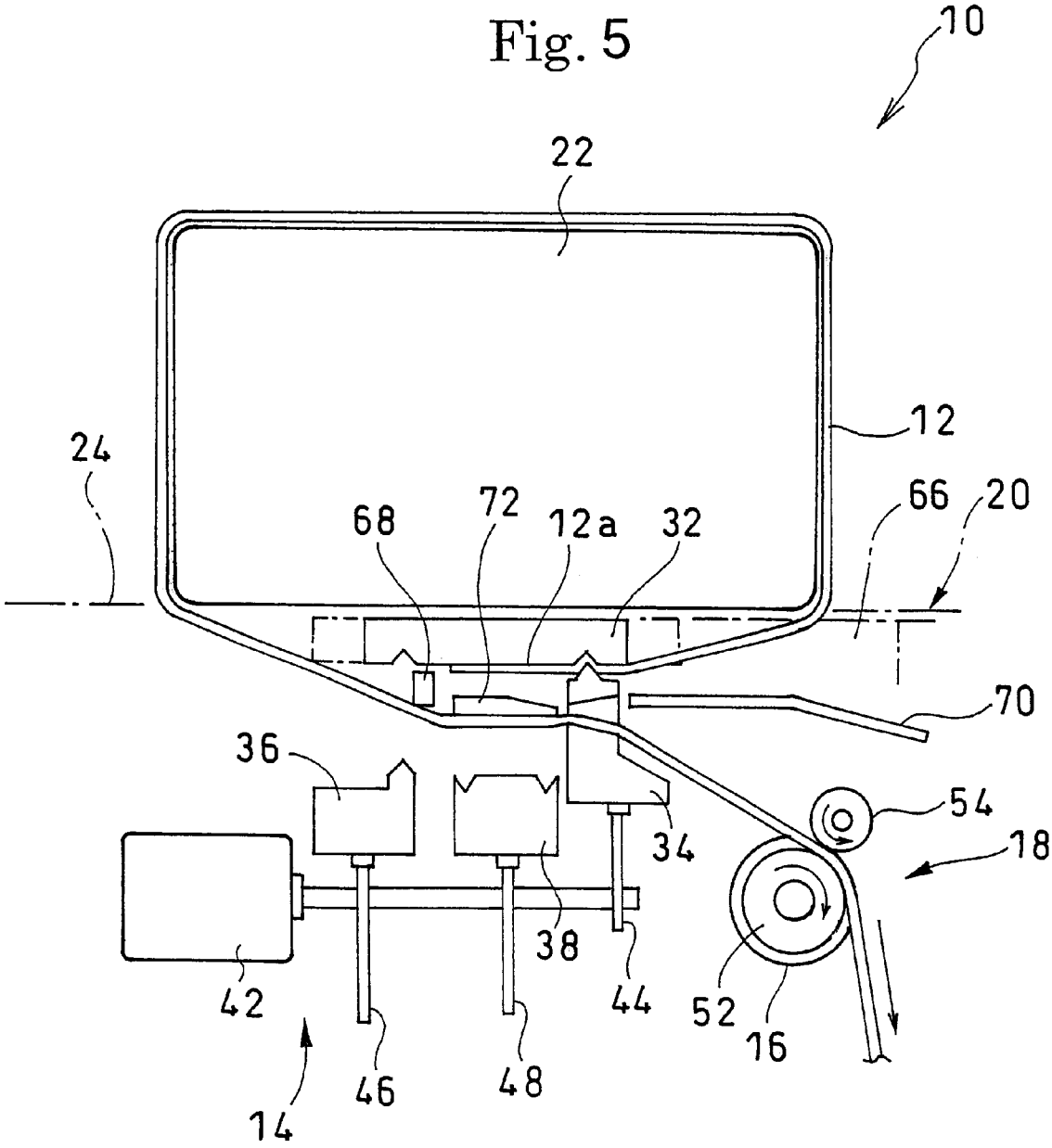
FIG. 5 is a diagram illustrating how the packing apparatus of the invention performs the band-tightening step.

In the manual mode, the drive motor 16 is driven when the operator turns on the manual-tightening switch 76. The drive roller 52 is thereby rotated clockwise as is illustrated in FIGS. 4 and 5. Then, the solenoid 55 is turned on, moving the touch roller 54. Thus moved, the touch roller 54 abuts on the drive roller 52. The band 12 is therefore clamped between the drive roller 52 and the touch roller 54. The band 12 is drawn back by a distance that is proportional to the angle through which the shaft of the drive motor 16, or the drive roller 52 has been rotated.

For example, the manual-tightening switch 76 may be a push-button switch. The switch 76 is turned on when pushed and is turned off when no longer pushed. The operator may intermittently push the manual-tightening switch 76, to draw back the band 12 gradually and, ultimately, tighten the band 12 around the article 22.

The next band-tightening step is not initiated even after the band-holding step. The apparatus 10 waits, holding the distal end 12*a* of the band 12 wrapped around the article 22. The article 22 has not been tightened with the band 12 yet and can, therefore, be freely adjusted in position on the table 24. The operator may adjust the position of the article 22 and may then operate the manual-tightening switch 76, thereby rotating the drive roller 52 to tighten the band 12 wrapped around the article 12 that has been adjusted in position. Moreover, the operator may intermittently operate the switch 76 to draw back the band 12 and tightening the same, step by step. In this specific manner, the operator can draw back the band 12 by any desired distance. Thus, the operator can tighten the band 12, while looking at the band 12 and, if necessary, touching the band 12 to detect the tension on the band 12. So long as this tension remains relatively small, the operator can adjust the position of the article 22 on the table 24. Furthermore, protective plates can be easily and quickly inserted into the gaps between the band 12 and the article 22, while the band 12 remains not drawn back or tightened. The protective plates can, of course, be arranged at desired positions on the article 22.

When the operator finds that the band 12 wrapped around the article 22 has been tightened to the desirable extent by operating the manual-tightening switch 76, he or she turns on the tightening stop switch 78. The switch 78 generates a manual-tightening end signal, which is supplied to the control means 28. Upon receipt of the manual-tightening end signal, the control means 28 generates various control signals. The control signals are supplied to the drive motor 16 and the sealing motor 42 and control these motors 16 and 42. The band-sealing step and the band-feeding step are automatically carried out in the order mentioned.

In the conventional packing apparatus, too, the drive motor is driven to rotate the drive roller, thereby to draw the band back. As far as this point is concerned, the packing apparatus 10 of this invention is identical to the conventional apparatus in basic construction. In the apparatus 10, however, the drive motor 16 is manually controlled to rotate the drive roller 52 intermittently. The apparatus 10 have only two additional switches that are not used in the conventional apparatus, i.e., the manual-tightening switch 76 and the tightening stop switch 78. Using only the two extra switches 76 and 78, the apparatus 10 achieves manual control of the band-tightening step. The packing apparatus 10 is not complex as compared with the conventional packing apparatus.

When the band-tightening step is completed, the solenoid 55 is turned off. The touch roller 54 therefore leaves the drive roller 52. Simultaneously, the drive motor 16 and the drive roller 52 are stopped. The next step, the band-sealing step, is automatically started.

In the band-sealing step, the sealing motor 42 is driven as can be understood from FIG. 6. As the motor 42 is driven, the cam 46 rotates, raising the left block 36. Thus raised, the left block 36 clamps the band 12 tightened, between the slide table 32 and the left block 36. The striker 68 and the band guide 72 move back from the positions where they are alignment with the band 12. At the same time, the heater 74 moves forward and is aligned with the band 12.

The heater 74 is one of the known structures and can move back and forth as a part of the sealing device 14. The heater 74 will not be described in terms of its structure and operation in details. As FIG. 3 shows, the heater 74 is electrically connected to the control means 28 and operates under the control of a control signal supplied from the control means 28.

After the cam 46 raises the left block 36, the cam 48 raises the center block 38. The cutter secured to the center block 38 cuts the band 12 as is shown in FIG. 6. As the center block 38 is further moved up, moving the heater 38 upwards until the heater 38 contacts the distal end 12*a* of the band 12 thus cut. The heater 38 melts the opposing surfaces of the distal and proximal ends of the band 12, which overlaps each other. Then, the heater 74 is moved back in a horizontal plane, from the position where the ends of the band 12 overlap. The center block 38 is further raised, pressing the distal and proximal ends of the band 12, against the slide table 32. The ends of the band 12 therefore fuse together. As a result, the distal and proximal ends of the band 12 are adhered to each other.

After the ends of the band 12 have been adhered together, the slide table 32 moves back from the position where it is aligned with the band 12, then the band-feeding step starts. Since the slide table 32 moves back, the band 12 wrapped around the article 22 is tightened and fixed to the article 22 as shown in FIG. 8.

Figure 8:
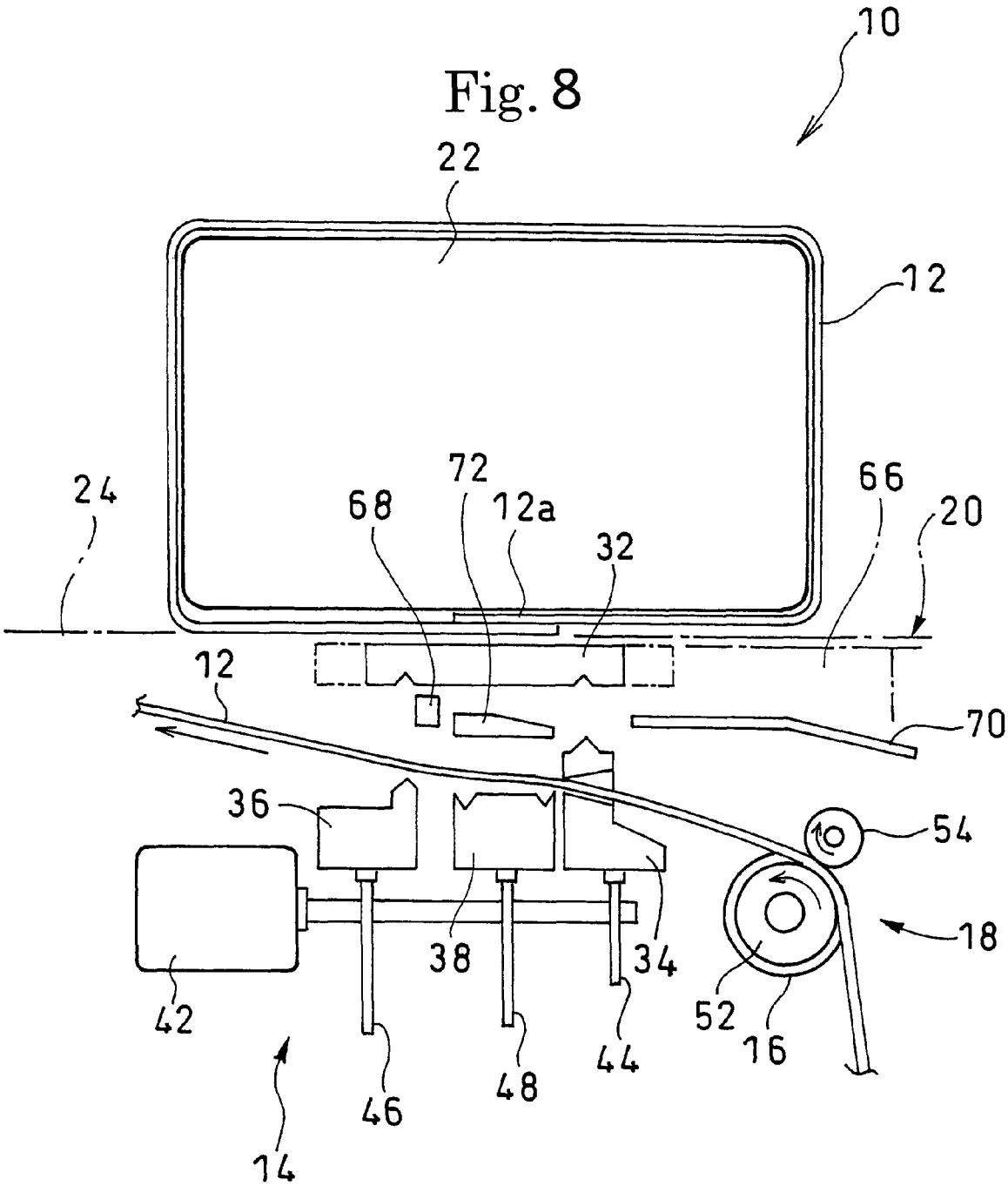
FIG. 8 is a diagram illustrating how the packing apparatus of the invention performs the band-feeding step.

In the band-feeding step, the slide table 32, band guide 72 and striker 68 move again forward to the position where they are aligned with the band 12, as is seen from FIG. 8. At the same time, the right block 34, left block 36 and center block 38 moves down to their initial positions as the sealing motor 42 rotates the cams 44, 46 and 48. When the blocks 34, 36 and 38 reach their initial positions, the sealing motor 42 is stopped.

Thereafter, the drive motor 16 is driven in the prescribed direction, rotating the drive roller 52. The solenoid 55 is turned on at the same time, bringing the touch roller 54 into contact with the drive roller 52. The band 12 is therefore clamped in the gap between the drive roller 52 and the touch roller 54. As the drive roller 52 rotates, the band 12 is fed forward from the band reel of the reel unit 26 by a distance set by turning the dial 62. The moment the band 12 is fed for that distance, the solenoid 55 is turned off and the drive motor 16 is stopped. This terminates the band-feeding step, whereby the packing apparatus 10 finishes one packing cycle. The apparatus 10 then waits, with the band 12 fed for said distance, until the next packing cycle is started.

The position and orientation of the band 12 wrapped around the article 22 and the force for tightening the band 12 wrapped around the article 22 can be adjusted as mentioned above. The apparatus 10 can pack the article 22, tightening the band 12 wrapped around the article 22 at a desired position, in a desired orientation and with an appropriate force. Since the band-tightening step (i.e., the step of drawing back the band 12) can be interrupted, the operator can insert protective plates between the article 22 and the band 12, both easily and quickly. The band 12 would not be tightened at a wrong position. Nor would the protective plates be displaced. The band 12 wrapped around the article 12 need not be cut to pack the article 22 again. This enhances the packing efficiency. Moreover, the band 12 wrapped around the article 22 can be tightened with a force appropriate in view of the type, shape and size of the article 22 because the operator adjusts the force in accordance with the condition he observes the article 22 being tied with the band 12. This ensures a high packing efficiency.

The operator may turn on, by mistake, the manual-tightening switch 76 before the apparatus 10 holds the distal end 12*a* of the band 12. If this is the case, the band 12 fed forward is pulled back. In view of this, it is desired that the manual-tightening switch 76 be turned on to rotate the drive roller 52 only after the distal end 12*a* of the band 12 is held, or only after the band-holding step is completed. For example, a switch that the cam 44 turns on after it raises the right block 34 may be connected in series to the manual-tightening switch 76. Then, the drive roller 52 will no rotate even if the operator turns on the manual-tightening switch 76 before the band-holding step is completed. Thus, the band 12 will not be drawn back unnecessarily.

Furthermore, the apparatus 10 may be designed so that the tightening stop switch 78 generates a manual-tightening end signal only when it is detected that the manual-tightening switch 76 has been operated. Then, the band-sealing step will not start even if the operator operates the tightening stop switch 78, by mistake, before operating the manual-tightening switch 76. This prevents an erroneous operation of the packing apparatus 10. To make the switch 78 generate a manual-tightening end signal only after the switch 76 has been operated, a limit switch may be connected in series to the switch 78 and may therefore be automatically turned on when the switch 76 is turned on.

Once the mode-changing switch 80 has been operated, setting the apparatus 10 into the automatic mode, the band-tightening step will be automatically started upon completion of the band-holding step at which the distal end 12*a* of the band 12 is held. Thus, the article 22 is packed in the same way as in the conventional semiautomatic packing apparatus.

In the embodiment, the operator may operate the mode-changing switch 80 to set the apparatus 10 into the manual mode or the automatic mode. In the manual mode, the apparatus 10 packs the article 22 in a way specific to the present invention. In the automatic mode, the apparatus 10 packs the article 22 in the same way as the conventional semiautomatic packing apparatus. The packing apparatus 10 therefore has a high practical value. The mode-changing switch 80 may be omitted, in which case the apparatus 10 operates in the manual mode only.

The apparatus 10 is a semiautomatic packing apparatus. Nonetheless, the present invention may be applied to an automatic packing apparatus. The invention can provide, for example, an automatic packing apparatus in which the drive motor is driven, drawing the band back and falling the band on the article from the arch unit, when the operator turns on the power switch and the start switch after placing the article on the table.

In the known automatic packing apparatus, the band wrapped around the article is drawn back, fallen from the arch unit and tightened around the article. In the automatic packing apparatus according to this invention, the drive motor stops when the band is pulled from the arch unit, and the band remains wrapped around the article. When the operator operates the manual-tightening switch after placing, if necessary, protective plates at desired positions and between the article and the band, the band-tightening step is carried out, tightening the band with an appropriate force. Upon completion of the band-tightening step, the operator turns on the tightening stop switch. The band-sealing step is thereby automatically initiated. When the article is packed, the band-feeding step and the band-inserting step are automatically performed. Then, the apparatus 10 waits for the next packing cycle.

In the embodiment described above, the drive motor 16 is a reversible motor. The drive motor 16 may be replaced by two motors, one for rotating the dive roller 52 in forward direction, and the other for rotating the drive roller 52 in reverse direction.

In the embodiment, the sealing device 14 has the sealing motor 42, while the band-feeding device 18 has the drive motor 16. The motors 16 and 42 may be replaced by one reversible motor. More specifically, the sealing motor 42 may be omitted and the drive motor 16 may be a reversible one, functioning as the sealing motor as well.

Further, the manual-tightening switch 76 and the tightening stop switch 78 may be replaced by one switch that has one movable contact and three fixed contacts. This switch turns on the drive motor when the movable contact is connected to the first fixed contact, turns off the drive motor when the movable contact is connected to the second fixed contact, and generates a manual-tightening end signal when the movable contact is connected to the third fixed contact. This switch can turn on and off the drive motor, without sliding the movable contact on the third fixed contact.

What is claimed is:

1. A packing apparatus comprising:

a sealing device having a sealing motor and configured to hold a distal end of a band and cut the band by operating the sealing motor after the band has been wrapped around an article and the distal end of the band has been inserted into a band insertion port, and to adhere the distal end and proximal end of the band to each other, said proximal end having been formed by cutting the band;

a band-feeding device having a drive motor and a drive roller and configured to feed the band by driving the drive motor in a prescribed direction, thereby rotating the drive roller, and to draw back the band and tighten the band around the article by driving the drive motor in the reverse direction opposite to the prescribed direction, thus rotating the driver roller in the reverse direction;

control means for controlling the sealing device and the band-feeding device;

a manual tightening switch to be turned on to drive the drive motor in the reverse direction and, hence, to rotate the drive roller in the reverse direction, thereby to draw back the band and tighten the band with a desired force; and a tightening stop switch to be operated to generate a manual-tightening end signal informing that the band-tightening step has been completed, wherein the manual tightening switch is operated while the distal end of the band remains held, thereby drawing back the band and tightening the band around the article, the sealing motor is automatically driven when the tightening stop switch is operated, thereby automatically cutting the band and automatically adhering the distal end and proximal end of the band, and the drive motor is automatically driven in the prescribed direction, thereby feeding the band for a prescribed distance.

2. The packing apparatus according to claim 1, wherein it is possible to operate the tightening stop switch only after the manual tightening switch has been operated.

3. The packing apparatus according to claim 2, which further comprises a mode-changing switch for switching an operating mode of the apparatus between an automatic mode and a manual mode, and in which the manual tightening switch and the tightening stop switch are effective after the mode-changing switch has been operated to set the manual mode and after the mode-changing switch to has been operated to set the automatic mode, the drive motor is automatically driven to draw back and tighten the band without operating the manually tightening switch and the tightening stop switch.

4. The packing apparatus according to claim 1, which further comprises a mode-changing switch for switching an operating mode of the apparatus between an automatic mode and a manual mode, and in which the manual tightening switch and the tightening stop switch are effective after the mode-changing switch has been operated to set the manual mode and after the mode-changing switch to has been operated to set the automatic mode, the drive motor is automatically driven to draw back and tighten the band without operating the manually tightening switch and the tightening stop switch.

5. The packing apparatus according to claim 4, which further comprises a striker on which the band inserted in the band insertion port abuts and which functions as a start switch to drive the sealing motor for holding the band when the band abuts on the striker and turns on the start switch while the band is being inserted into the band insertion port.

6. The packing apparatus according to claim 4, which further comprises an arch unit having a band passage and designed to cause the band to fall onto the article when the band is drawn back, and in which the drive motor is automatically driven when the start switch is turned on, thereby feeding the band to the arch unit and inserting the band into the band insertion port and thereby automatically driving the sealing motor to hold the band.

* * * * *